US008225701B2

(12) United States Patent
Vainer et al.

(10) Patent No.: US 8,225,701 B2
(45) Date of Patent: Jul. 24, 2012

(54) TYRE SEGMENTING DEVICE

(76) Inventors: Michael Vainer, Highett (AU); Boris Rozenblit, Hampton (AU)

( * ) Notice: Subject to any disclaimer, the term of this patent is extended or adjusted under 35 U.S.C. 154(b) by 561 days.

(21) Appl. No.: 12/514,924

(22) PCT Filed: Nov. 12, 2007

(86) PCT No.: PCT/AU2007/001433

§ 371 (c)(1),
(2), (4) Date: May 14, 2009

(87) PCT Pub. No.: WO2008/061285

PCT Pub. Date: May 29, 2008

(65) Prior Publication Data

US 2010/0064868 A1 Mar. 18, 2010

(30) Foreign Application Priority Data

Nov. 23, 2006 (AU) ..... 2006241342

(51) Int. Cl.
*B26D 3/24* (2006.01)
*B26D 5/08* (2006.01)

(52) U.S. Cl. ..... 83/54; 83/112; 83/569; 83/620

(58) Field of Classification Search ..... 83/951, 83/133, 175, 13, 54, 112, 569, 620, 923
See application file for complete search history.

(56) References Cited

U.S. PATENT DOCUMENTS

| | | | | |
|---|---|---|---|---|
| 3,389,626 | A * | 6/1968 | Wise | 83/868 |
| 3,701,296 | A * | 10/1972 | Snow | 82/54 |
| 3,937,076 | A * | 2/1976 | Pommellet et al. | 73/146 |
| 4,338,840 | A * | 7/1982 | Farrell et al. | 83/622 |
| 4,355,556 | A * | 10/1982 | Ulsky | 83/124 |
| 4,694,716 | A * | 9/1987 | Sakamoto | 83/112 |
| 4,873,759 | A * | 10/1989 | Burch | 29/700 |
| 5,267,496 | A | 12/1993 | Roach et al. | |
| 5,551,325 | A * | 9/1996 | Schutt | 83/133 |
| 5,601,004 | A | 2/1997 | Queen | |
| 5,765,727 | A * | 6/1998 | Masley | 225/3 |
| 6,240,819 | B1 * | 6/2001 | Su et al. | 83/176 |

FOREIGN PATENT DOCUMENTS

JP 49-15781 A 2/1974

* cited by examiner

*Primary Examiner* — Sean Michalski
(74) *Attorney, Agent, or Firm* — David A. Guerra

(57) ABSTRACT

The present invention relates to a tire segmenting device capable of cutting tires into two or more segments, the device including: a cutter for dividing the tire into two or more segments; a positioning device on which the tire is mounted, the positioning device positioning a tire mounted thereon in alignment with the cutter; and a moving device operatively connected to the positioning device; wherein in use, the moving device moves the positioning device between a loading position in which a tire can be loaded and unloaded from the positioning device and a cutting position where the cutter engages the tire and divides the tire into the two or more segments.

20 Claims, 5 Drawing Sheets

TYRE SEGMENTING DEVICE

CROSS-REFERENCE TO RELATED APPLICATIONS

This application is an U.S. national phase application under 35 U.S.C. §371 based upon co-pending International Application No. PCT/AU2007/001433 filed on Nov. 12, 2007. Additionally, this U.S. national phase application claims the benefit of priority of co-pending International Application No. PCT/AU2007/001433 filed on Nov. 12, 2007 and Australia Application No. 2006241342 filed on Nov. 23, 2006. The entire disclosures of the prior applications are incorporated herein by reference. The international application was published on May 29, 2008 under Publication No. WO 2008/061285.

FIELD OF THE INVENTION

The present invention generally relates to a device capable of segmenting tyres. More particularly, the present invention relates to a tyre segmenting device that can be included as a part of a larger tyre processing/recycling process and it will be convenient to hereinafter disclose the invention in relation to that exemplary application. However, it is to be appreciated that the invention is not strictly limited to that application, and may be used in segmenting tyres or other similar objects that can then be used for other subsequent applications.

BACKGROUND OF THE INVENTION

The following discussion of the background to the invention is intended to facilitate an understanding of the invention. However, it should be appreciated that the discussion is not an acknowledgement or admission that any of the material referred to was published, known or part of the common general knowledge as at the priority date of the application.

A vehicle tyre (or tire) is a generally a circular ring shaped covering manufactured from rubber and reinforcing steel which is fitted over the outer circumference of a vehicle wheel. Most vehicle tyres since at least the 1960s have been made from a composite material that includes rubber reinforced with cords of polyester, steel, and/or other textile materials. This composite material has varying configurations in different functional sections of the tyre in order to provide different properties of strength, resilience and shape in accordance with the function of that section. A tyre can therefore generally be said to include three distinct compositional sections:

The crown, located generally around the outer perimeter of the tyre formed from a thick section of rubber that includes rigid steel belts for reinforcement to give high mileage and performance. The crown includes an outer surface having various designs of jagged shaped grooves in it, known as the tread.

The sidewalls are the radial sections of the tyre between the crown and the inner circular edges of the tyre contacting the wheel rim. The sidewalls include a number of radial reinforcing cords that add to the resilience of the sidewall.

The bead located at the inner rim of the tyre and is reinforced with a number of concentric circumferential reinforcing steel wires.

Even with reinforcement, vehicle tyres have a limited life and will eventually have to be replaced. Many such used tyres are subsequently processed and recycled in order to reuse the rubber and steel constituents of the tyre. As the tyre structure has different composition in each section, it is desirable to separate the tyre into these different sections in order to process the different sections separately. A number of tyre recycling processes are known to the applicant that separate the tyre into at least two separate compositional sections. In several prior processes known to the applicant, the recycling process includes a cutting process that separates the sidewalls of the tyre from the crown of the tyre. A number of processes also longitudinally cut each of the sidewall section and crown section into two or more symmetrical parts using various cutting devices such as circular saws, cutting blades or the like.

However, most prior tyre segmenting processes tend to be complicated, using a number of interrupted processes to separate the various sections of the tyre. Some prior tyre segmenting processes also require stoppages between each step in order to load and unload the tyre from the segmenting device and/or during the cutting process in order to utilise different cutting devices to divide the tyre in to the various compositional sections.

It would therefore be desirable to provide an alternative tyre segmenting device that was generally simpler than prior tyre segmenting devices. Furthermore, it would be preferable for this device to include a positioning device that would aid in aligning and positioning a tyre in the cutting device in order to provide more continuous and preferably faster processing of the tyre.

SUMMARY OF THE INVENTION

According to the present invention, there is provided a tyre segmenting device including:

a cutter for dividing the tyre into two or more segments;

a positioning device on which the tyre is mounted, the positioning device positioning a tyre mounted thereon in alignment with the cutter; and a moving device operatively connected to the positioning device;

wherein in use, the moving device moves the positioning device between a loading position in which a tyre can be loaded and unloaded from the positioning device and a cutting position where the cutter engages the tyre and divides the tyre into the two or more segments.

It is to be understood that the term "segment" encompasses portions of a tyre of any size, shape or form.

The tyre segmenting device according to the present invention therefore provides a simple device having a number of interrelated components which can divide, preferably cut, a tyre into separate segments in a substantially continuous process. In this respect, a tyre is loaded on the positioning device and aligned with a cutting device. The positioning device and tyre mounted thereon is then moved to the cutting position where the cutting device divides the tyre into a desired number and type of segments. Preferably, the positioning device forces the tyre into engagement with and through the cutting device in order to divide the tyre in the desired segments.

Once the tyre is divided into the various segments, the positioning device can be moved back to the loading position and a new tyre loaded onto the positioning device for the next segmenting process. Typically, the loading process of the new tyre onto the positioning device displaces the segments of the segmented tyre left on the positioning device, unloading these segmented sections from the device. In some embodiments, a conveyer belt or other collection device can be positioned at a location where these segmented tyre sections fall from the positioning device and therefore allow the segmented sections to be transported to other devices and processes for further processing such as sizing, separation, comminution or the like.

Positioning a tyre on the positioning device can be accomplished using various arrangements. In one embodiment, the positioning device includes a recess or cavity into which a tyre can be mounted, the walls of the cavity being configured to align the tyre with the cutting device. In another more preferred embodiment, the positioning device includes an alignment hub which in use extends through the central hole of a tyre mounted thereon, preferably engaging the inner rim of the tyre, in order to position the tyre in alignment with the cutter. In this respect, the alignment hub and cutter are preferably aligned, and therefore once the tyre is moved into alignment with the hub, it too is aligned with the cutter.

The positioning device can include further components which aid in loading, holding and unloading the tyre from the segmenting device. In some embodiments, the positioning device further includes a mounting plate on which the tyre is supported. Typically, the mounting plate is a planar plate on which the base of the tyre engages. As can be appreciated, the presence of a hub in the center of such a loading plate can restrict the way in which the tyre is loaded onto the positioning device, with the tyre having to be loaded for a generally perpendicular position relative to the mounting plate in order to place the tyre over the hub. It is therefore preferable for the alignment hub to be movable between a retracted position wherein the alignment hub is located below the mounting plate, and an extended position wherein at least a portion of the alignment hub extends above the mounting plate. In this manner the tyre can be laterally loaded, slid or otherwise moved onto the mounting plate from one side of the plate, and then the alignment hub can be raised into the extended position through the center of the tyre.

The alignment hub can be moved between the extended position and retracted position using a number of moving means. In some embodiments, movement of the alignment hub is provided by a separate motor or means to the moving device. However, in more preferred embodiments, the alignment hub is operatively connected to the moving device, the moving device lifting the alignment hub between the retracted position and the extended position.

The moving device of the present invention can be any suitable reciprocating or powered device. In some forms the moving device is a motor which drives one or more articulated sections in order to move the movable parts of the device. In other forms the moving device is a screw device. In yet other forms, the moving device includes at least one hydraulic piston.

As can be appreciated, the mounting plate would also be moved between the loading position and cutting position along with the other interconnected sections of the positioning device. Again, this could in some embodiments be achieved by a separate means to the moving means. However, it is preferable that the mounting plate is also operatively moved by the moving device. More preferably, the mounting plate is seated on a section of the positioning device when in the extended position. Accordingly, movement of the hub towards the cutting position (as moved by the moving device) will also move the mounting plate towards the cutting position.

The hub can have any number of suitable configurations that center and align a tyre mounted on the positioning device with the cutter. In one embodiment, the hub comprises a conical surface which extends through a circular hub aperture in the mounting plate. In another embodiment, the hub is formed from two or more generally circumferentially spaced apart arms which extend from a base support to form a generally frustoconical shaped structure.

The hub can have a solid or fixed configuration or could be configured to have a more flexible configuration which can alter in response to pressure or other forces bearing on the positioning device or tyre. In one preferred embodiment, each of the arms forming the hub have an upper distal end pivotably mounted to an upper support and a lower proximal end mounted in a radial guide allowing lateral movement of the proximal end relative to the base support. In this embodiment, the lower proximal end of each arm is pivotably mounted to a slide, the slide laterally movable along the length of the radial guide. Preferably, the slide is captured within the radial guide. Each radial guide also typically includes a biasing means that biases the proximal end of each arm towards an outer circumferential position in the radial guide. The hub will therefore preferentially form into a generally frustoconical shape with the maximum diameter corresponding to the outer circumferential position in the radial guide. However, if any inwardly directed radial force acts on the arms of the hub, such as for example a circumferential constriction, then the base of the hub arms can move radially inwards in response to the constriction force(s).

In many embodiments, the mounting plate would include one or more hub apertures through which at least part of the structure of the hub can extend so as to allow the alignment hub to move between the extended position and retracted position. In preferred embodiments, each hub aperture defines an outer circumferential limit having a diameter which is greater than the typical inner rim diameter of tyre being processed by the segmenting device. Therefore, when the tyre is pressed against the cutter in the cutting position, the limited size of aperture defined by the rim of the tyre provides a circumferential constriction force on the arms of the hub. With enough force, the base of the hub arms can move radially inwards in response to these constriction forces changing the angle of frustoconical shape of the hub. This should allow the tyre to be more forcefully squashed between the mounting plate and the cutter.

In those embodiments of the invention where the positioning device includes a mounting plate, it is preferable for the mounting plate to include one or more cutter recesses into which part of the structure, preferably the leading edge, of the cutter can extend. In some embodiments, some or all of the recesses form apertures through the mounting plate. These recesses allow at least the leading edges of the cutting sections to extend completely through the tyre mounted on the mounting plate, and therefore allow the cutter to completely cut through the tyre and separate the various divided segments of the tyre from one another.

While the cutting device and positioning device can be effective in segmenting the tyre, it is possible that the resilient and flexible nature of the tyre material could result in one or more segments of the cut tyre being caught or otherwise lodged in the cutter. It is therefore preferable that the segmenting device further includes a separator which extends into and in some cases through the cutter after the tyre is divided by the cutter. Preferably, the separator extends into the cutter when the positioning device moves from the cutting position to the loading position so as to disengage the segmented tyre sections from the cutter. The separator can include any form and configuration of device which can be used to dislodge caught segments from the cutter. In one preferred form, the separator includes two or more fingers which, in use, extend through the cutter in predetermined positions when the positioning device moves from the cutting position to the loading position.

The separator is preferably moved between the cutting sections of the cutter after the tyre is cut into segments by the cutter. Preferably, this movement would occur during or after the positioning device has moved from the cutting position back to the loading position. As can be appreciated, the direction of movement of the positioning device from the cutting position back to the loading position is in generally the same direction or movement that the separator moves in order to extends through the cutter. It is therefore preferable for the separator to be operatively connected to the moving device. In this manner, movement of the positioning device from the cutting position back to the loading position can also move the fingers of the separator from a position out of the cutter to a position extending within the cutter. Such an operative connection can be formed using one or more connector arms which connect the separator to the positioning device. In those embodiments in which the positioning device includes a base plate, the operative connection can be formed using one or more connector arms which connect the separator to the base plate.

Of course, the exact configuration and type of segments into which a tyre can be cut generally depends on the configuration of the cutting sections of the cutter. Preferably, the cutting blades would be configured to separate the tyre into at least two of the three different general sections. In order to achieve this, the cutter can include at least one generally circumferential blade for separating the crown of the tyre from the sidewalls. The cutter can also include at least one generally circumferential blade for separating the bead of the tyre from the sidewalls. It is also desirable to cut these segments into two or more smaller sections for handling and subsequent processing purposes. Accordingly, the cutter can also include one or more radial blades for radially dividing the tyre.

As can be appreciated, it would be preferable for the cutter to include at least two circumferential blades which separate the bead section, sidewall sections and crown section of the tyre into separate sections. In this regard, the cutter would include both a generally circumferential blade for separating the crown of the tyre from the sidewalls and a generally circumferential blade for separating the bead of the tyre from the sidewalls. Advantageously, this particular cutter embodiment would divide the tyre into two or more different sections having different internal composition and/or structure that can then be treated separately during subsequent processing steps.

In order to guide movement of the moving parts of the segmenting device it is preferable for the device to further include at least one guide rail between the cutter and the positioning device for guiding movement of the positioning device between the loading and cutting positions. In some embodiments, the separator is also mounted on the guide rail.

The speed of processing tyres in the segmenting device can be increased through the inclusion of a tyre supply and feeding device. Many forms of tyre supply and feeding devices are possible, such as for example conveyor belts, mechanical arm arrangements, slide chutes or the like. However, in one preferred embodiment, the segmenting device further includes a stacking frame in which two or more tyres can be stacked prior to loading on the positioning device. In some preferred embodiments, the tyre stacker also includes a lateral reciprocating arm which moves a tyre from the base of the stacking frame to the positioning device. Advantageously, loading of the new tyre onto the positioning device through the action of the reciprocating arm tends also to displace and thereby unload any sections of the segmented tyre located on the positioning device.

It should be appreciated that the segmenting device according to the present invention can be used to segment any numerous forms and types of tyres ranging from bicycles tyres to large tractor and aircraft tyres. However, given the number of automobiles and other like vehicle currently in use and the number of discard tyres these types of vehicles produce each year, the segmenting device is most preferably configured for segmenting light vehicle tyres.

Preferably, in use, the segmenting device loads a tyre, positions a tyre on the positioning device in alignment with the cutter, cuts the tyre using the cutter and unloads the tyre segments from the device in a continuos process.

According to another aspect of the present invention, there is provided a method of segmenting a tyre including:

mounting a tyre on a positioning device which positions a tyre mounted thereon in alignment with a cutter;

moving the positioning device and tyre mounted thereon into a cutting position where the tyre is in engagement with the cutter using a moving device which is operatively connected to the positioning device; and dividing the tyre into two or more segments using the cutter.

In one preferred embodiment, each step in the method is performed in a continuous process.

Preferably, the method according to the present invention is performed using the segmenting device according to the present invention.

BRIEF DESCRIPTION OF THE DRAWINGS

The present invention will now be described with reference to the figures of the accompanying drawings, which illustrate a particular preferred embodiment of the present invention, wherein.

DETAILED DESCRIPTION

Figure 1:
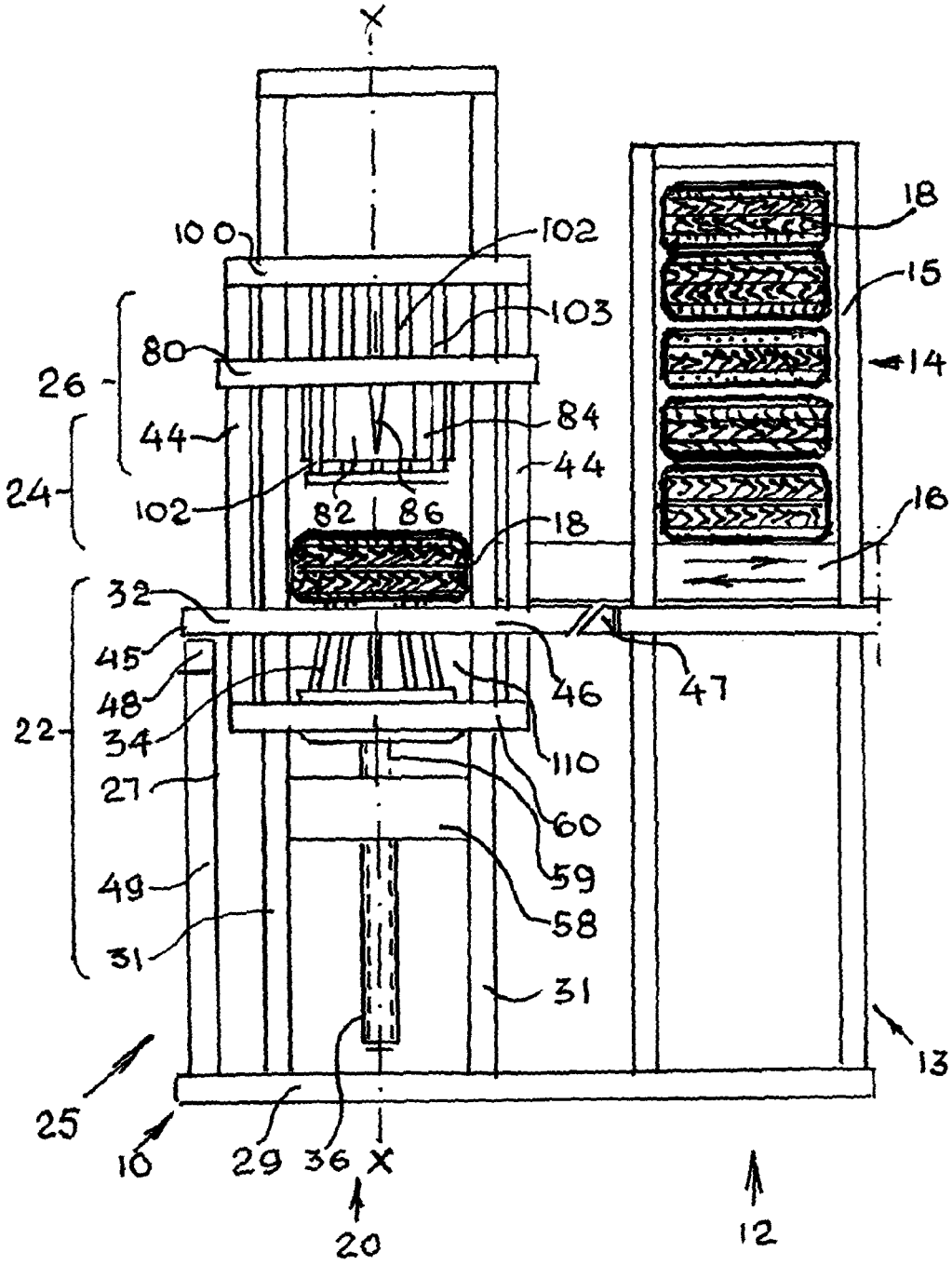
FIG. 1 is front elevation view of one preferred embodiment of the segmenting device according to the present invention.

Referring to FIG. 1, there is shown one preferred embodiment of a tyre 18 segmenting device 10 according to the present invention. The illustrated segmenting device 10 is used to cut tyre 18 into a predetermined number of segments which can then be used in further downstream recycling processes to produce various rubber, steel and rubber and steel composite products. It should therefore be appreciated that the configuration of the segments that each tyre 18 is cut into can be varied to suit the requirements of these downstream processes.

The illustrated segmenting device 10 includes two distinct sections, being a stacking section 12 and segmenting section 20.

The stacking section 12 is used for stacking and storing tyre 18 ready for processing in the second segmenting section 20. As shown, the stacking section 12 consists of a metal framework structure 13 having a vertical tyre stack 14 constructed of a framework box 15 in which a number of tyre 18 can be vertically stacked and a reciprocating feeding arm 16 located at the base of the tyre stack 14 for feeding tyre 18 stored in the tyre stack 14 to the segmenting section 20. The illustrated reciprocating feeding arm 16 is a rectangular rod which is attached to a hydraulic piston arm (not illustrated). The piston arm is moveable from a retracted position (not shown) in which the leading face of the feeding arm 16 is retracted from the base of the tyre stack 14 and an extended position (as illustrated in FIG. 1) in which the feeding arm 16 is fully extended and the leading face of the feeding arm 16 has engaged the bottom tyre 18 of the tyre stack 14 and moves said tyre 18 to the segmenting section 20 ready for processing.

The segmenting section 20 is the processing section of the segmenting device 10 and includes components which engage and cut a tyre 18 into the desired segments ready for further processing in other downstream process equipment. In order to cut the tyre 18 into the desired number of segments, the segmenting section 20 includes a number of interconnected parts, which can be generally classified into three sections, namely a positioning section 22, a cutting section 24 and a separator section 26. Each of these sections 22, 24 and 26 are vertically mounted on a skeletal support frame 25 including vertical support posts 27 and base 29. Each of the positioning section 22 and separator sections 26 are vertically movable relative to the cutting section 24 about four spaced apart vertical guide rails 31. Each of these sections 22, 24 and 26 will now be described in more detail.

Referring to FIGS. 1 to 5, there is shown the components making up the positioning section 22 of the illustrated tyre 18 segmenting device 10. The positioning section 22 is location where a tyre 18 is initially loaded into the segmenting section 20 from the tyre stacking section 12. The positioning section 22 functions to receive the tyre 18 from the reciprocating arm 16, center and align the tyre 18 with the cutting section 24 and raise the tyre 18 into engagement with a cutter blade 82 of the cutting section 24. Three interacting components, a mounting plate 32, an alignment hub 34 and a screw device 36 are used to achieve this function.

Figure 2:
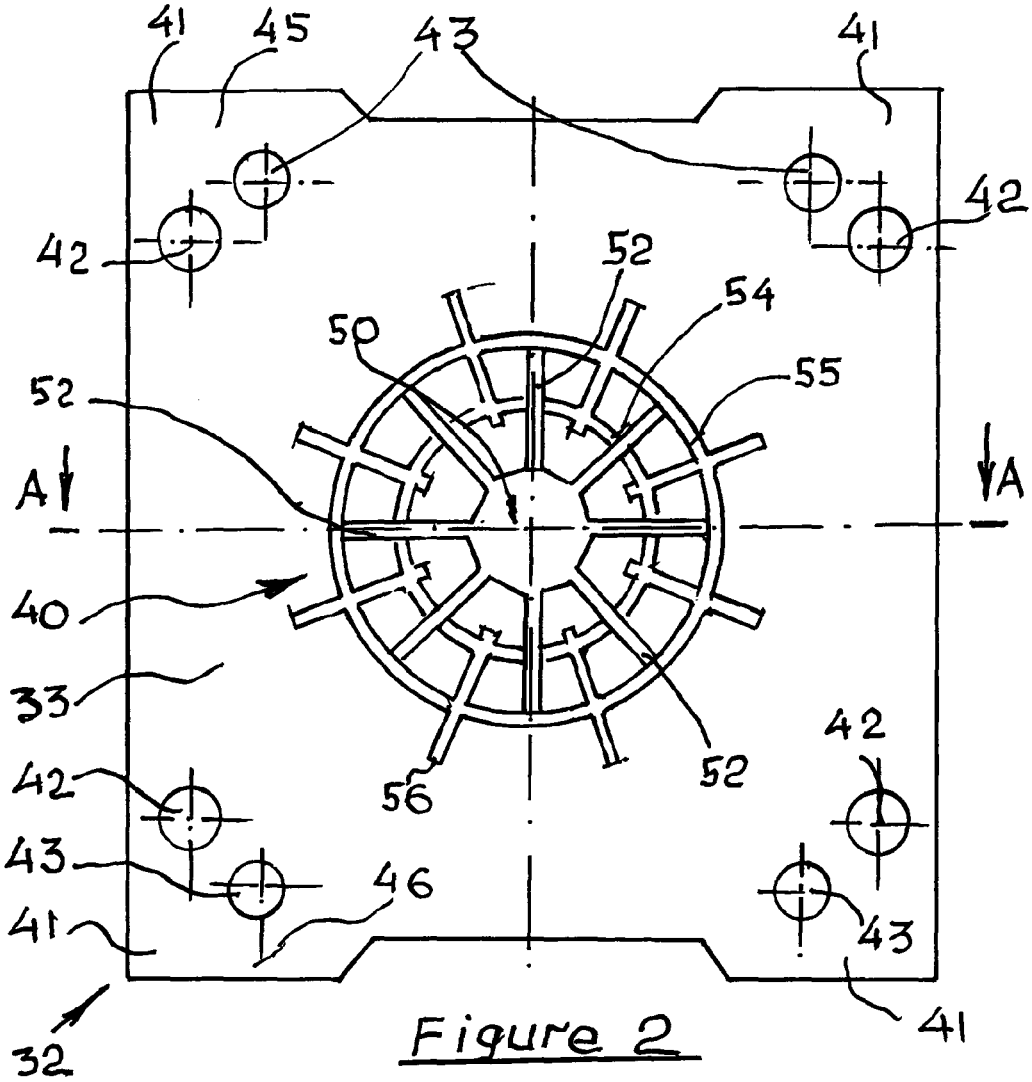
FIG. 2 is a plan view of the mounting plate of the segmenting device shown in FIG. 1.
Figure 3:
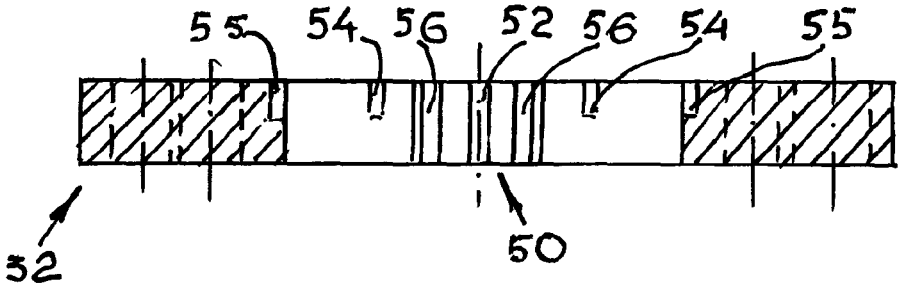
FIG. 3 is a section front elevation view of the mounting plate along line A-A of FIG. 2.

The mounting plate 32 is shown in FIGS. 1 to 3. The function of the mounting plate 32 is to provide a flat mounting area on which a tyre 18 can be received from the stacking section 12. The mounting plate 32 also supports the tyre 18 during the segmenting process when the tyre 18 is engaged with the cutting section 24. As best shown in FIGS. 2 and 3, the mounting plate 32 consists of a generally rectangular planar plate which is horizontally orientated with respect to the guide rails 31. A tyre 18 is received and supported on the upper surface 33 of the mounting plate 32.

The mounting plate 32 is vertically movable about the guide rails 31. As shown in FIG. 2, the mounting plate 32 includes eight outer holes, defining rail holes 42 and connector holes 43. Each of the four guide rails 31 are threaded through one of the four rail holes 42. Each of the rail holes 42 is sized to allow the mounting plate 32 to move freely upwardly and downwardly about the guide rails 31. The other connector holes 43 accommodate one of four connecting rods 44 that connect the alignment hub 34 to the separator section 26, as will be described in more detail later in the specification. Again, each of the connector holes 43 are sized to allow the mounting plate 32 to move freely upwardly and downwardly about the connecting rods 44.

Vertical movement of the mounting plate 32 is between a seated position, as shown in FIG. 1 and a raised position, where the mounting plate 32 and a tyre 18 supported thereon is raised towards the cutting section 24. As shown in FIG. 2, the mounting plate includes four flange sections 41. In the seated position each of the flanges 41 of the mounting plate are seated on a respective receiving edge of the skeletal support frame 25. As best seen in FIG. 1, each of the flanges 41 can be specifically configured to fit a certain receiving edge 47, 49 of the skeletal support frame 25. For example, flange 46 is configured with an upwardly tapered edge which is received on a downwardly tapered edge of receiving edge 47 of the skeletal support frame 25. On the other hand, flange 45 includes an extension section 48 which is seated on support rod 49 of the skeletal support frame 25.

Referring again to FIGS. 2 and 3, it can be seen that the mounting plate 32 includes a central grate like hub aperture 40. The hub aperture 40 includes a central circular aperture 50, having eight spaced apart radial slots 52 extending therefrom. The hub aperture 40 is shaped to allow the alignment hub 34 to pass through and interact with a tyre 18 mounted on the mounting plate 32. The upper surface 33 of the mounting plate 32 also include two concentric circular grooves 54, 55 arranged concentrically around the central aperture 50. The circular grooves 54, 55 are interconnected by a series of radial grooves 56 which are equally spaced around the circumference of the circular grooves 54, 55. The pattern of the grooves 54, 55 and 56 correspond to the configuration of the leading edge of the blades 82 of the cutting section 24, and are configured to receive the leading edges of the blades 82 during operation of the segmenting device 10.

The screw device 36 is best shown in FIG. 1. As illustrated, the screw device 36 is fixedly mounted to the guide rails 31 through mounting arrangement 58 such that the cylinder of the screw device 36 is mounted in a fixed position relative to the guide rails 31 and frame 25. As can be appreciated, the screw device 36 includes a screw 59 which can move between a retracted position, as shown in FIG. 1 and an extended position (not illustrated). In the illustrated embodiment, the screw 59 is attached to the underside of a base plate 60 of the alignment hub 34, and in operation moves the positioning hub 34 and attached components vertically upwardly and downwardly along the guide rails 31.

Figure 4:
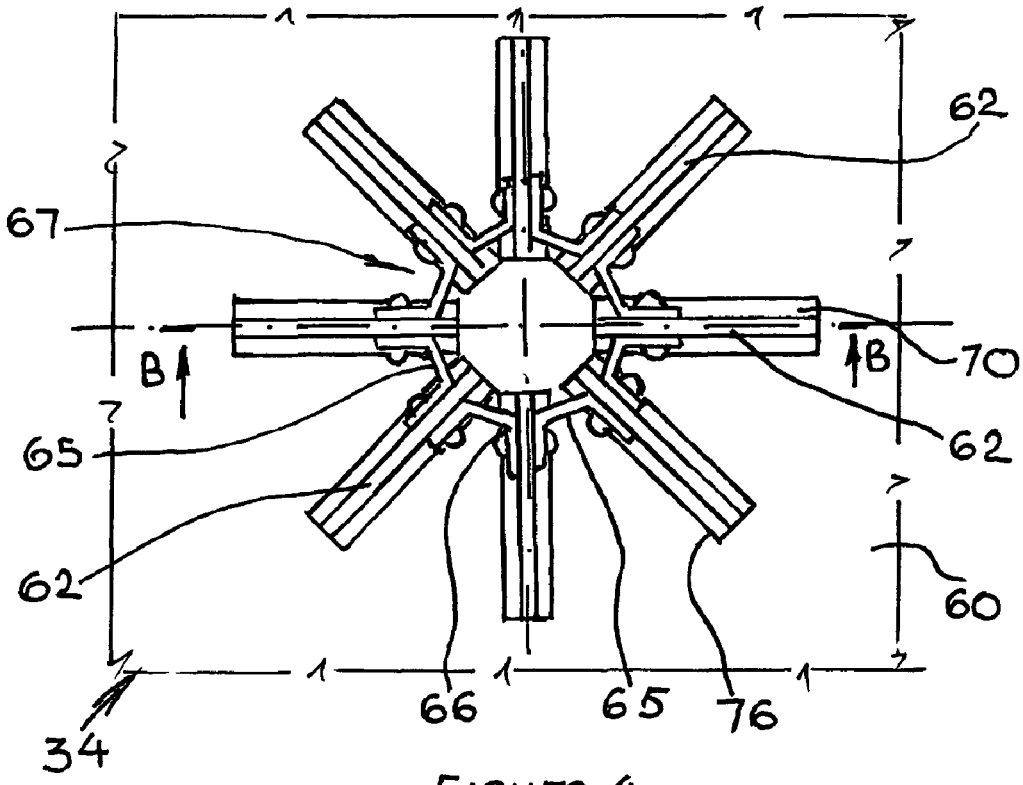
FIG. 4 is a plan view of the alignment hub of the segmenting device shown in FIG. 1.
Figure 5:
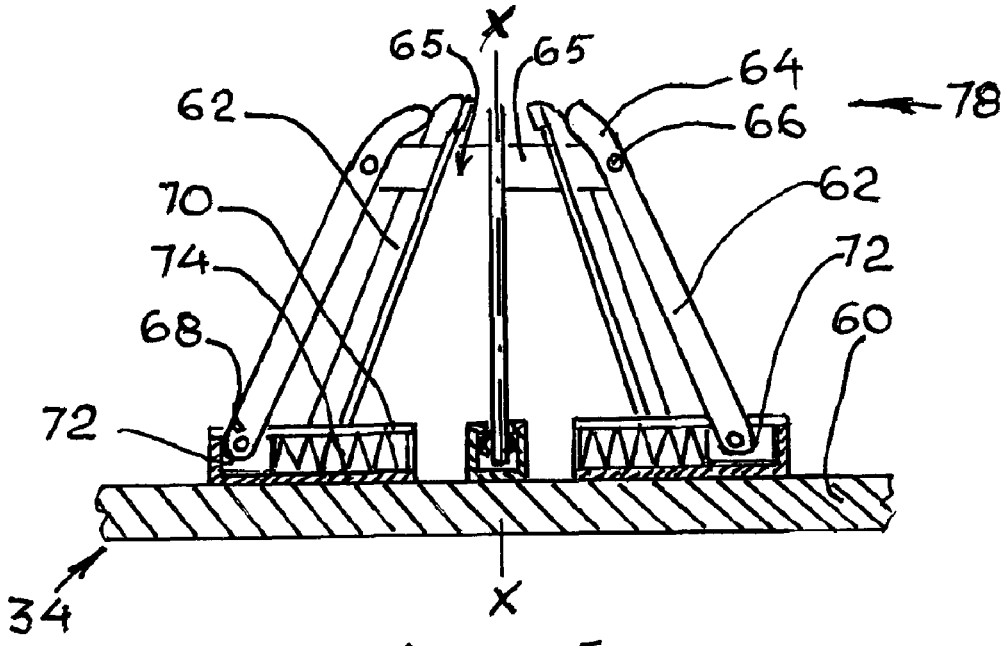
FIG. 5 is a section front elevation view of the alignment hub along line B-B of FIG. 4.

The alignment hub 34 is shown in FIGS. 1, 4 and 5. The function of the alignment hub 34 is to center and align a tyre 18 mounted on the mounting plate 32 with the cutting section 24. As best shown in FIGS. 4 and 5, the alignment hub 34 is formed from an arrangement of eight hub rods 62 which are interconnected to form a skeletal framework having a general frustoconical shape. Each hub rods 62 is radially mounted about a hub axis X-X and extend along radial paths which are generally equally spaced apart around a circumference centred at the hub axis X-X. Each of the eight hub rods 62 are secured into position in the alignment hub 34 at the extreme ends of each hub rod 62.

The distal end 64 of each hub rod 62 is pivotably connected to an adjacent hub rod 64 through a hub connector ring section 65. As shown, a pin 66 is inserted through clamping ends of each connector ring section 65 and the respective sandwiched distal end 64 of each hub rod 62 to form a pivot connection. Each connector ring section 65 interconnects the distal ends 64 of each hub rod 62 to form an overall upper support ring structure 67.

The proximal end 68 of each hub rod 62 is pivotably fastened within a sliding rail guide 70. Each rail guide 70 is radially mounted on the upper surface of the base plate 60 about a hub axis X-X and extends along a radial path, each of which are generally equally spaced apart from the others around a circumference centred at the hub axis X-X. Each rail guide 70 defines a radial track along its length along which the proximal end 68 can move if a constriction force is placed around the hub rods 62. In order to enable the proximal end 68 of each rod 62 to slide within the rail guide 70, the proximal end 68 is pivotably connected to a rectangular shoe slide 72 which is captured within the structure of the rail guide 70. As can be appreciated, the shoe slide 72 can laterally move within the respective rail guide 70. In order to ensure the hub rods 62 preferentially take the general frustoconical shape shown in FIG. 5, each rail guide 70 includes a spring biasing means 74 within the rail guide 70 between the shoe slide 72 and inner wall of the rail guide 70. The illustrated spring biasing means 74 is a helical wound spring, though it should be appreciated other configurations of biasing means could also be used for the same function. The spring biasing means 74 biases the proximal end 68 of each hub rod 62 to the outer circumferential limit 76 defined by each the rail guide 70. However, if an inwardly directed force, such as for example a circumferential constriction or the like is applied to each hub rod 62, then the biasing force of the spring 74 can be countered and the proximal end of each hub rod 62 can move inwardly towards axis X-X, increasing the slope of the sides of the general frustoconical shape of the alignment hub 34.

Although not clearly shown in FIGS. 4 and 5, the base plate 60 is vertically movable about the guide rails 31 through four rail holes (not illustrated) similar to those shown for the mounting plate 32. Each rail hole is sized to allow the base plate 60 to move freely upwardly and downwardly about the guide rails 31.

Four connecting rods 44 also extend vertically from the base plate 60 to a base plate 100 of the separator section 26 in order to interconnect movement of the positioning section 22 with the separator section 26, as will be described in more detail later in the specification. It is also possible in some embodiments for the connecting rod 44 to extend vertically from the mounting plate 32.

The alignment hub 34 can be moved by the screw 59 so that the upper leading end 78 of the alignment hub 34 is inserted through the hub aperture 40, which is specifically configured for this purpose. As shown in FIG. 1, the alignment hub 34 is raised so that the top of the alignment hub 34 is inserted and extends through the hub aperture 40 and through the center of the tyre 18 mounted thereon. As can be appreciated, the sloped sides of the alignment hub 34 can contact the inner edges of the tyre 18 in the process. As the alignment hub 34 is progressively inserted through the hub aperture 40, the tyre 18 is therefore centred and aligned around the alignment hub 34. Of course, the position of the hub aperture 40 is aligned with the cutting section 24 of the segmenting device 10. Accordingly, the tyre 18 therefore aligned by this process with the cutting section 24.

Once the sides of the hub rods 62 reach the outer limits or constriction of the hub aperture 40, the mounting plate 32 is seated on the hub rods 62, and is lifted upwardly with movement of hub 34 with mounted tyre 18 towards the cutting section 24.

Figure 6:
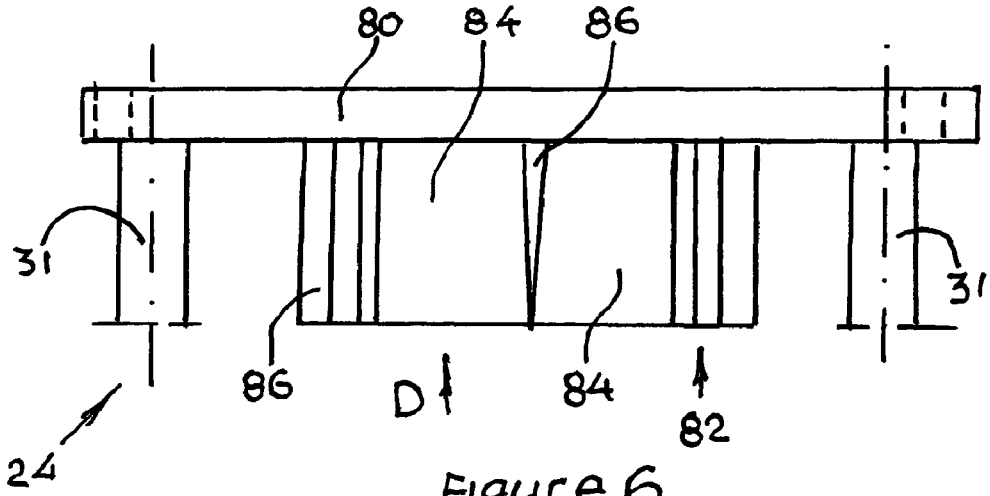
FIG. 6 is a front elevation view of the cutting section of the segmenting device shown in FIG. 1.
Figure 7:
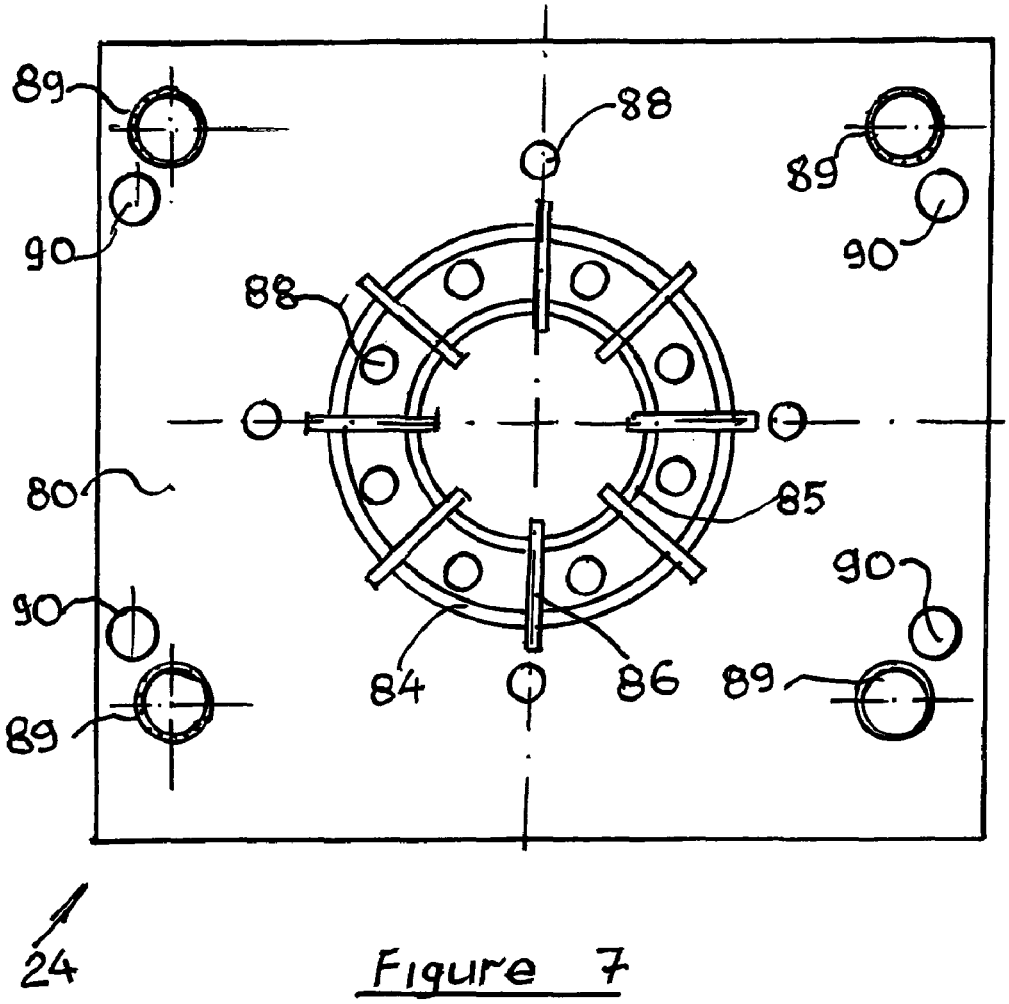
FIG. 7 is a plan view of the cutting section in direction D shown in FIG. 6.

Now moving to FIGS. 1, 6 and 7, it can be seen that the cutting section 24 is formed by a horizontal base plate 80 from which downwardly extending cutting blades 82 are fixed. The cutting blades 82 of the illustrated embodiment are configured to segment a tyre 18 into the bead section, sidewall sections and crown section of the tyre 18 and also radially cut the tyre 18 into smaller sections. In this regard, the cutting blades 82 include both a first circumferential blade 84 for separating the crown of the tyre 18 from the sidewalls of the tyre 18, a second circumferential blade 85 for separating the bead of the tyre 18 from the sidewalls of the tyre 18 and also eight radial blades 86 for cutting these sections into smaller segments. As should be appreciate, this particular blade configuration segments a tyre 18 into a number of different sections having different internal composition and/or structure that can then be, if desired, treated separately during subsequent processing steps.

The illustrated cutting section 24 also includes a pattern of separator apertures 88 located in the base plate 80. The separator apertures 88 have a pattern matching the configuration of separator rods 102 of the separator section 26, and allow these separator rods 102 to pass into the cutting section 24 through these apertures 88.

The base plate 80 is vertically fixed to the guide rails 31 through four rail holes 89, in the illustrated case through welding of the base plate 80 to the rails 31 at the base of each of the rail holes 89. The cutting section 24 is therefore vertically fixed in this position. Conversely, four connector holes 90 are also provided to accommodate one of four connecting rods 44 that connect the alignment hub 34 to the separator section 26, as will be described in more detail later in the specification. Each connector holes 90 is sized to allow the four connecting rods 44 to move freely upwardly and downwardly through the respective connector hole 90.

Figure 8:
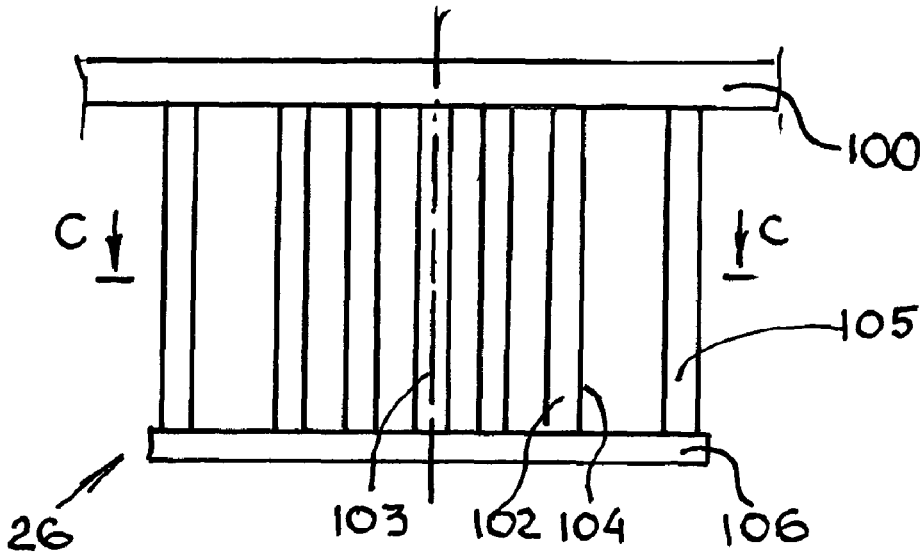
FIG. 8 is a front elevation view of the separator section of the segmenting device shown in FIG. 1.
Figure 9:
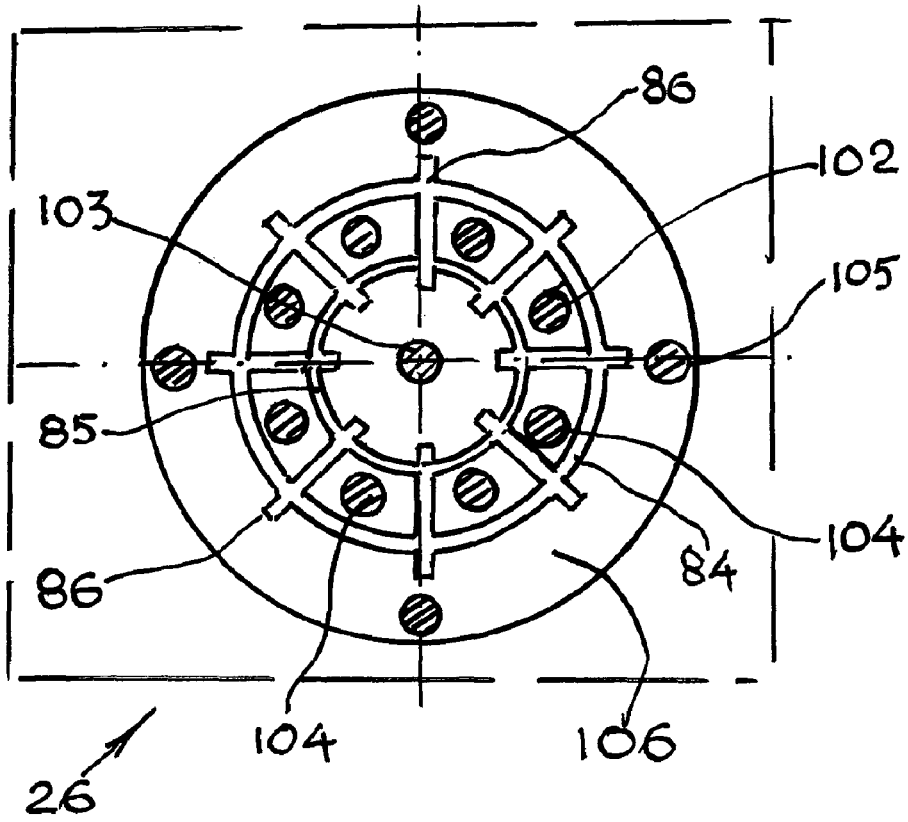
FIG. 9 is a sectional plan view of the separation section along line C-C of FIG. 8.

Referring now to FIGS. 1, 8 and 9, there is shown the separator section 26 of the illustrated segmenting device 10. The separator section 26 functions to separate or extract any sections of the segmented tyre 18 that may be caught or trapped within the cutting section 24 after the tyre cutting process.

The separator section 26 comprises a base plate 100, from which downwardly separator finger or rods 102 are fixed. The separator rods 102 are arranged in three sections, being central separator rod 103, an inner uncapped circular formation 104 and a capped outer circular formation 105. Each separator rod section 103, 104, 105 extends through a particular gap between the blades 82 of the cutting section 24. As best shown in FIG. 9, the central separator rod 103 is located within the interior of the second circumferential blade 85, the inner uncapped circular formation 104 is located between the first 84 and second 85 circumferential blades and each of the radial blades 86, and the capped outer circular formation 105 is located outside of the first circumferential blades 84. The outer circular formation 105 is also capped with a circular ring plate 106 that extends a ring formation around the circumference circumscribed by the separator rods 102 of the outer circular formation 105.

As noted previously, the separator rods 102 extend through the separator apertures 88 and into the cutter section 24. After cutting, the separator rods 102 and ring plate 106 are moved downwardly through the cutting section 24, and effectively knock out any segments of the segmented tyre 18 that may be caught or trapped within the cutting section 24 after the tyre cutting process.

Although not clearly shown in FIG. 1, 8 or 9, movement of the separator section 26 is vertically movable about the guide rails 31 about four rail holes (not illustrated) similar to those shown for the mounting plate 32. Each rail hole is sized to allow the base plate 100 to move freely upwardly and downwardly about the guide rails 31.

Four connecting rods 44 also extend vertically from the base plate 100 of the separator section 26 to the base plate 60 of the alignment hub 34 so as to interconnect movement of the positioning section 22 with the separator section 26. In this respect, the length of each connector rod 44 is selected to allow the separator rods 102 of the separator section 26 to be substantially retracted from the cutting section 24 when the tyre 18 is raised into engagement with the blades 82 of the cutting section 24 and for the separator rods 102 of the separator section 26 to extend into the cutting section 24 when the alignment hub 34 is being lowered after segmenting the tyre 18.

In operation, a tyre 18 from the bottom of the tyre stack 14 in the stacking section 12 is pushed from the bottom of the tyre stack 14 to the mounting plate 32 by the reciprocating arm 16. At this point, the segmenting section 20 is in a loading configuration with the alignment hub 34 positioned below the mounting plate 32, thereby allowing the tyre 18 to be slid unhindered onto the mounting plate 32. The reciprocating arm 16 is sized to generally position the tyre 18 with the central interior hole generally over the hub aperture 50. Once in position, the alignment hub 34 is progressively raised through the hub aperture 40, and specifically apertures 50 and 52, of the operation of the screw device 36 and extension of screw 59 thereof. As the alignment hub 34 travels through the hub aperture 40, the sides of the hub rods 62 contact the inner rim of the tyre 18 and align the tyre 18 with the blades 82 of the cutting section 24. The hub rods 62 generally extend completely through hub aperture 40, and thus the mounting plate 32 will be seated on the base plate 60. The hub rods 62 fix the tyre 18 in place through this contact with the inner rim of the tyre 18. Thus, in most cases, the tyre 18 will be seated on the hub rods 62.

The mounting plate 32 and the base plate 60 continue their joint movement upwards towards the cutting blade 82 until such time as the base plate 60 abuts the mounting plate 32 and forces the tyre 18 upwards onto the cutting blades 82. The separator rods 102 also retract out from the cutter section 24 concurrently with the upwards movement of the alignment hub 34.

Once the tyre 18 reaches the cutting section 26, the tyre 18 is forced into and through the blades 82 through the force of the upwards movement of the alignment hub 34 and seated mounting plate 32. The cutting blades 82 are forced completely through the tyre 18 making a through-cut and are received in the corresponding grooves 54, 55 and 56 on the upper surface 33 of the mounting plate 32.

During this upwards movement through the cutting blades 82, the hub rods 62 maintain their contact with the inner rim of the tyre 18. However, at this point the proximal ends 68 of the hub rods 62 are also designed to move radially towards central axis X-X. In this respect, when the tyre 18 is being cut, the upwards force from the screw device 36 forces the hub rods 62 further through hub aperture 40. This action causes a circumferential constriction or the like to be applied to each hub rod 62, countering the biasing force of the spring 74. This causes the proximal end 68 of each hub rod 62 to move inwardly towards axis X-X, increasing the slope of the sides of the general frustoconical shape of the alignment hub 34. The tyre 18 is therefore substantially free from engagement with the alignment hub 34 and can therefore be squashed between the mounting plate 32 and structure of the cutting section 24.

Once the cutting procedure is completed, the alignment hub 34 and mounting plate 32 seated thereon is lowered by operation of the screw device 36. Concurrently, the separator rods 102 of the separator section 26 extend into the cutting section 24 and knock any segments of the cut tyre 18 caught in the cutter section onto the mounting plate 32. The alignment hub 34 and mounting plate 32 are lowered, until the mounting plate 32 is seated back on the respective receiving edges 47, 49 of the skeletal support frame 25. The alignment hub 34 can then be lowered out from the hub aperture 40 and below the mounting plate 32 to place the segmenting section 20 back into the loading position.

At this point a tyre 18 from the bottom of the tyre stack 14 in the stacking section 12 can again be pushed from the bottom of the stack 14 to the mounting plate 32 by the reciprocating arm 16. The loading of a new tyre 18 from the tyre stack 14 onto the mounting plate 32 also tends to displace and thereby unload any sections of the segmented tyre 18 still on the mounting plate 32. As can be appreciated, a conveyer belt or other collection device (not illustrated) can be positioned at a location where these segmented tyre 18 sections fall from the mounting plate 32 and therefore allow the segmented sections of the tyre 18 to be transported to other devices and process for further processing such as separation, comminution or the like.

It should be appreciated that the segmenting device 10 can be constructed from any suitable material. However, in order to provide the required strength it is preferred that the various components of the segmenting device 10 are constructed of metal such as steel, stainless steel, brass, copper or the like.

It should be realised that in some embodiments of the invention, a flexible connector (not illustrated) such as a strap or chain can be provided to connected the mounting plate 32 to the base plate 60 of the positioning section 22 in the position indicated by reference 110 in FIG. 1. The function of the flexible connector is to ensure the mounting plate 32 moves downwardly with the positioning section 22 when the positioning section 22 is lowered after the tyre 18 is segmented by the cutting blades 82.

In another preferred embodiment of the invention (not illustrated) a dampening device such as a spring or the like can be provided between the mounting plate 32 and base plate 60 in order to dampen or otherwise soften the abutment between these two plates when the device is in operation.

Those skilled in the art will appreciate that the invention described herein is susceptible to variations and modifications other than those specifically described. It is understood that the invention includes all such variations and modifications which fall within the spirit and scope of the present invention.

The claims defining the invention are as follows:

1. A tire segmenting device comprising:

at least one cutter for dividing a tire into two or more segments, said cutter comprising: at least one first circumferential blade for separating a crown of said tire from sidewalls of said tire; at least one second circumferential blade concentric of said first circumferential blade for separating a bead of said tire from said sidewalls of said tire; and at least one radial blade for radially dividing said tire, said first and second circumferential blades and said radial blade each extending from a base plate;

a positioning device on which said tire is mounted, said positioning device positioning said tire mounted thereon in alignment with said cutter, said positioning device comprising a mounting plate which supports said tire, and an alignment hub extendable through a central hole of said tire mounted on said positioning device in order to position said tire in alignment with said cutter; and a moving device operatively connected to said positioning device which moves said alignment hub between a retracted position and an extended position, said retracted position being where said alignment hub is located below said mounting plate, said extended position being where at least a portion of said alignment hub extends above said mounting plate;

wherein said moving device being adapted to move said positioning device between a loading position in which said tire can be loaded and unloaded from said positioning device and a cutting position where said cutter engages said tire and divides said tire into the two or more segments.

2. The tire segmenting device according to claim 1, wherein said alignment hub is formed from three or more generally circumferentially spaced apart arms which extend from a base support to form a substantially frustoconical shaped structure.

3. The tire segmenting device according to claim 2, wherein each of said arms forming said alignment hub have an upper distal end pivotably mounted to an upper support and a lower proximal end mounted in a radial guide allowing lateral movement of said proximal end relative to said base support.

4. The tire segmenting device according to claim 3, wherein said lower proximal end of each arm is pivotably mounted to a slide, said slide being captured within and laterally movable along a length of said radial guide.

5. The tire segmenting device according to claim 3, wherein each said radial guide further comprising a biasing means that biases said lower proximal ends of each arm towards an outer circumferential position in said radial guide.

6. The tire segmenting device according to claim 1, wherein said mounting plate further comprising at least one hub aperture through which at least part of a structure of said alignment hub can extend.

7. The tire segmenting device according to claim 1, wherein said mounting plate further comprising at least one cutter recess into which part of a structure of said cutter can extend.

8. The tire segmenting device according to claim 1 further including a separator which extends through said cutter after said tire is divided by said cutter.

9. The tire segmenting device according to claim 8, wherein said separator extends through said cutter when said positioning device moves from said cutting position to said loading position so as to disengage the segmented tire sections from said cutter, and wherein said separator further comprising two or more fingers which are adapted to extend through said cutter in predetermined positions when said positioning device moves from said cutting position to said loading position;

and wherein said separator is operatively connected to said moving device.

10. The tire segmenting device according to claim 8, wherein said separator is connected to said positioning device through at least one connector arm.

11. The tire segmenting device according to claim 10 further comprising at least one guide rail between said cutter and said positioning device for guiding movement of said positioning device between said loading and cutting positions.

12. The tire segmenting device according to claim 11, wherein said separator is mounted on said guide rail.

13. The tire segmenting device according to claim 1 further comprising a stacking frame in which two or more of said tires can be stacked prior to loading on said positioning device, wherein said stacking frame comprising a lateral reciprocating arm which moves a tire from a base of said stacking frame to said positioning device.

14. A method of segmenting a tire using a tire segmenting device, said method comprising the steps of:

a) providing a tire segmenting device comprising:

at least one cutter having at least one first circumferential blade, at least one second circumferential blade concentric of said first circumferential blade, and at least one radial blade;

a positioning device having a mounting plate, and an alignment hub which; and a moving device operatively connected to said positioning device;

b) mounting a tire on said mounting plate of said positioning device which positions said tire mounted thereon in alignment with said cutter;

c) extending said alignment hub through a central hole of said tire mounted on said mounting plate in order to position said tire in alignment with said cutter;

d) moving said positioning device and tire mounted thereon into a cutting position where said tire is in engagement with said cutter using said moving device which is operatively connected to said positioning device; and e) cutting a crown of said tire from sidewalls of said tire using said first circumferential blade, cutting a bead of said tire from said sidewalls of said tire using said second circumferential blade, and dividing said tire into radial segments using said radial blade.

15. The method according to claim 14, wherein steps b-e are performed in a continuous process.

16. A tire segmenting device comprising:

at least one cutter for dividing a tire into two or more segments, said cutter comprising: at least one first circumferential blade for separating a crown of said tire from sidewalls of said tire; at least one second circumferential blade concentric of said first circumferential blade for separating a bead of said tire from said sidewalls of said tire; and at least one radial blade for radially dividing said tire;

a positioning device on which said tire is mounted, said positioning device being configured to position said tire mounted thereon in alignment with said cutter, said position device comprising a mounting plate which supports said tire, and an alignment hub extendable through a central hole of said tire mounted on said positioning device in order to position said tire in alignment with said cutter; and a moving device operatively connected to said positioning device which moves said alignment hub between a retracted position and an extended position, said retracted position being where said alignment hub is located below said mounting plate, said extended position being where at least a portion of said alignment hub extends above said mounting plate and through at least one hub aperture defined through said mounting plate;

wherein said moving device being adapted to move said positioning device between a loading position in which said tire can be loaded and unloaded from said positioning device and a cutting position where said cutter engages said tire and divides said tire into the two or more segments;

wherein said alignment hub is formed from three or more circumferentially spaced apart arms which extend from a base support to form a substantially frustoconical shaped structure.

17. The tire segmenting device according to claim 16, wherein each of said arms having an upper distal end pivotably mounted to an upper support and a lower proximal end mounted in a radial guide allowing lateral movement of said proximal end relative to said base support, said lower proximal end of each arm is pivotably mounted to a slide, said slide being captured within and laterally movable along a length of said radial guide, and wherein each said radial guide further comprising a biasing means that biases said lower proximal ends of each arm towards an outer circumferential position in said radial guide.

18. The tire segmenting device according to claim 16 further comprising a separator connected to said positioning device through at least one connector arm, said separator extends through said cutter after said tire is divided by said cutter, said separator extends through said cutter when said positioning device moves from said cutting position to said loading position to disengage the segmented tire sections from said cutter, and wherein said separator further comprising two or more fingers which are adapted to extend through said cutter in predetermined positions when said positioning device moves from said cutting position to said loading position;

and wherein said separator is operatively connected to said moving device.

19. The tire segmenting device according to claim 16 further comprising a stacking frame in which two or more of said tires can be stacked prior to loading on said positioning device, wherein said stacking frame comprising a lateral reciprocating arm which moves a tire from a base of said stacking frame to said positioning device.

20. The tire segmenting device according to claim 16 further comprising a stacking frame in which two or more of said tires can be stacked prior to loading on said positioning device, wherein said stacking frame comprising a lateral reciprocating arm which moves a tire from a base of said stacking frame to said positioning device.

* * * * *